US006082828A

United States Patent [19]

Bailey et al.

[11] Patent Number: 6,082,828

[45] Date of Patent: Jul. 4, 2000

[54] MINE GALLERY CURTAIN AND METHOD

[76] Inventors: Philip E. Bailey, 101 Churchill Cir.; Rick L. Jones, 214 S. Hampton Dr., both of Bristol, Tenn. 37620; John M. Scales, 6347 Rosecommon Dr., Norcross, Ga. 30092; Frank B. Akers, III, 4815 Hunters Meadow La., Alpharetta, Ga. 30004

[21] Appl. No.: 08/825,473

[22] Filed: Mar. 28, 1997

Related U.S. Application Data

[63] Continuation-in-part of application No. 08/637,488, Apr. 24, 1996, abandoned.

[51] Int. Cl.[7] ..... E21F 15/04

[52] U.S. Cl. ..... 299/12; 405/288

[58] Field of Search ..... 405/288, 289, 405/303, 132, 141, 144; 299/11, 12

[56] References Cited

U.S. PATENT DOCUMENTS

| | | | |
|---|---|---|---|
| Re. 34,220 | 4/1993 | Kennedy et al. | 405/132 |
| 3,645,337 | 2/1972 | Livingston | 169/14 |
| 3,831,318 | 8/1974 | Richmond | 49/31 |
| 4,023,372 | 5/1977 | Presler et al. | 61/45 |
| 4,036,024 | 7/1977 | Drecker et al. | 61/42 |
| 4,077,474 | 3/1978 | Hattori | 169/48 |
| 4,102,138 | 7/1978 | Dreker et al. | 61/42 |
| 4,175,481 | 11/1979 | Burgess, Jr. | 98/50 |
| 4,277,204 | 7/1981 | Koppers et al. | 405/288 |
| 4,516,879 | 5/1985 | Berry et al. | 405/132 |
| 4,687,790 | 8/1987 | Andreichuk | 523/130 |
| 4,983,077 | 1/1991 | Sorge et al. | 405/288 |
| 5,043,019 | 8/1991 | Chervenak et al. | 106/612 |
| 5,143,340 | 9/1992 | Wood et al. | 248/354.2 |
| 5,308,196 | 5/1994 | Frederick | 405/288 |

FOREIGN PATENT DOCUMENTS

| | | |
|---|---|---|
| WO 90/15224 | 12/1990 | WIPO . |
| WO 91/06746 | 5/1991 | WIPO . |

*Primary Examiner*—William Neuder
*Assistant Examiner*—Frederick L. Lagman
*Attorney, Agent, or Firm*—Kennedy, Davis & Hodge, LLP

[57] ABSTRACT

A curtain for defining a barrier in an underground passageway between a pair of spaced-apart pillars, comprising a bladder defined by a pair of flexible sheets joined together by a plurality of cords which define a cavity between the sheets and being open at a top edge thereof. The bladder is fastened to a ceiling of an underground passageway between a pair of spaced-apart pillars therein. A rigid foam is disposed within the cavity, being formed of a flowable hardenable material introduced into the cavity. A fire-retardant coating is applied to exposed surfaces of the bladder after the hardenable material has hardened. A method of closing gaps between pillars in mine galleries is disclosed.

15 Claims, 3 Drawing Sheets

MINE GALLERY CURTAIN AND METHOD

The present application is a continuation-in-part of application Ser. No. 08/637,488 filed Apr. 24, 1996, now abandoned.

TECHNICAL FIELD

The present invention relates to apparatus and methods for closing-off mine galleries. More particularly, the present invention relates to suspended curtains that define bladders filled with hardenable foams for closing-off mine galleries, especially for use in defining passageways for communicating air through mines.

BACKGROUND OF THE INVENTION

Mine galleries are open areas underground which result from the underground excavation of minerals, such as coal. Mines typically have a number of galleries at various depths from the surface. Galleries are accessed by elevators from the surface, tracks, or haulage ways. Pillars of rock and minerals, typically twenty feet wide by fifty feet long, are left within the galleries in spaced-apart relation to define roof or ceiling supports in the galleries. In coal mines, the galleries are typically formed with three to eight foot ceilings and the pillars are approximately twenty feet apart. The gallery increases in size through the excavation and removal of rock and minerals. The excavation face in the gallery is thereby located farther from the mine entrance. All equipment, supplies, materials, and personnel enter and exit the gallery through the elevator, track, or haulage ways. The demands on the entrance ways accordingly may be significant, depending on the depth of the mine, the number of galleries, the number of miners and other workers, and the activity in the mine.

Fresh cool air is needed at the excavation face for the miners and other workers. The fresh air is communicated from an intake, across the working face, and out of the mine through a return. To control air flow and reduce the demands on the volume of air required, the gaps between adjacent pillars are walled-ir to define separate passageways. There are various types of barriers used to form walls in galleries. A number of barriers have been previously described for blocking off mine entries or other types of underground passageways. For example, U.S. Pat. No. 4,077,474 to Hattori discloses a curtain of fire-resistant fabric releasable from a frame above an entry. U.S. Pat. No. 3,831,318 to Richmond discloses a series of inflatable bags which, when inflated with air, converge together to block the opening or passageway. Similarly, U.S. Pat. Nos. 4,102,138 and 4,036,024 to Dreker disclose an inflatable bag, initially filled with air, which is later filled with a material of a type which permanently blocks the mine passageway. U.S. Pat. No. 3,645,337 to Livingston discloses an overhead chamber through which a gel is excreted to form a curtain of synthetic material which dries into a solid blockade. U.S. Pat. No. 4,023,372 to Preslar discloses a partially inflatable wall of fabric which allows passage therethrough. U.S. Pat. No. 4,277,204 to Koppers and U.S. Pat. No. 4,983,077 to Sorge disclose the use of self-supporting forms filled with hardenable material to support the roof of the mines.

A current technology typically used to form walls, commonly called "stoppings" and "seals", to block mine openings and close the gaps between pillars, are constructed of conventional concrete or cinder blocks. These are usually stacked without mortar, and have a resistant coating applied to the exposed surfaces of the blocks to bond the blocks together. This construction technique is allowed under The US Code of Federal Regulations (CFR) which requires stoppings to have the "structural equivalent to an 8-inch, hollow-core, concrete block stopping with mortared joints." (Mine Safety & Health Administration Report 07-183-93 (Jul. 2, 1993).

While providing a satisfactory stopping, the concrete block walls have drawbacks. Construction of such stoppings are time and labor intensive, and each stopping wall typically requires eight to ten, or more, manhours to construct. Each wall requires a large number of blocks, which must be brought into the mine through the entrance to the gallery. The workers who assemble the stoppings also must travel into the mine through the elevator, track, or haulage ways. These materials and the workers involved place overhead demands on the mine entrance way and increase mine costs which are not directly related to excavation of minerals.

Stoppings must provide the equivalent critical properties to that of concrete blocks as defined by 30 CFR Part 75.333 with respect to durability, noncombustibility and surface flammability:

1) one hour fire resistance as described in ASTM 119 Fire Resistance;
2) transverse load strength as described in ASTM E72-80 in excess of 39 pounds per square foot and
3) flame spread index of less than 25 as described ASTM El 62.

The stoppings also must provide a substantially air tight wall for closing-off of mine galleries, which results in passageways primarily used to direct air flow within the mine. Masonry walls are sealed with an overcoat. However, conventional concrete-block stoppings are often damaged by strata movement after installation. The damage may result in cracks in the blocks and joints which allows air to pass freely.

Accordingly, there is a need in the art for an improved apparatus and method for closing-off mine galleries.

SUMMARY OF THE INVENTION

The present invention overcomes the problems of the prior art by providing stoppings and method for closing-off mine galleries with a curtain that defines a barrier in an underground passageway between a pair of spaced-apart pillars in a mine. The curtain comprises a bladder defined by a pair of flexible sheets joined together by a plurality of spaced-apart connectors extending between the sheets. The sheets define a cavity therebetween. The bladder is secured with fasteners to a ceiling of an underground passageway between a pair of spaced-apart pillars. A foam is disposed within the cavity. The foam is formed of a flowable hardenable material introduced into the cavity. The foam is formed of a low density material in a range of between about 0.5 to about 5 pounds of the hardenable material per cubic foot of foam. In a preferred embodiment, a fire-retardant coating is applied to an exposed surface of the bladder after the hardenable material has hardened.

Objects, advantages and features of the present invention will become apparent from a reading of the following detailed description of the invention and claims in view of the appended drawings.

DETAILED DESCRIPTION OF THE PREFERRED EMBODIMENTS

Figure 1:
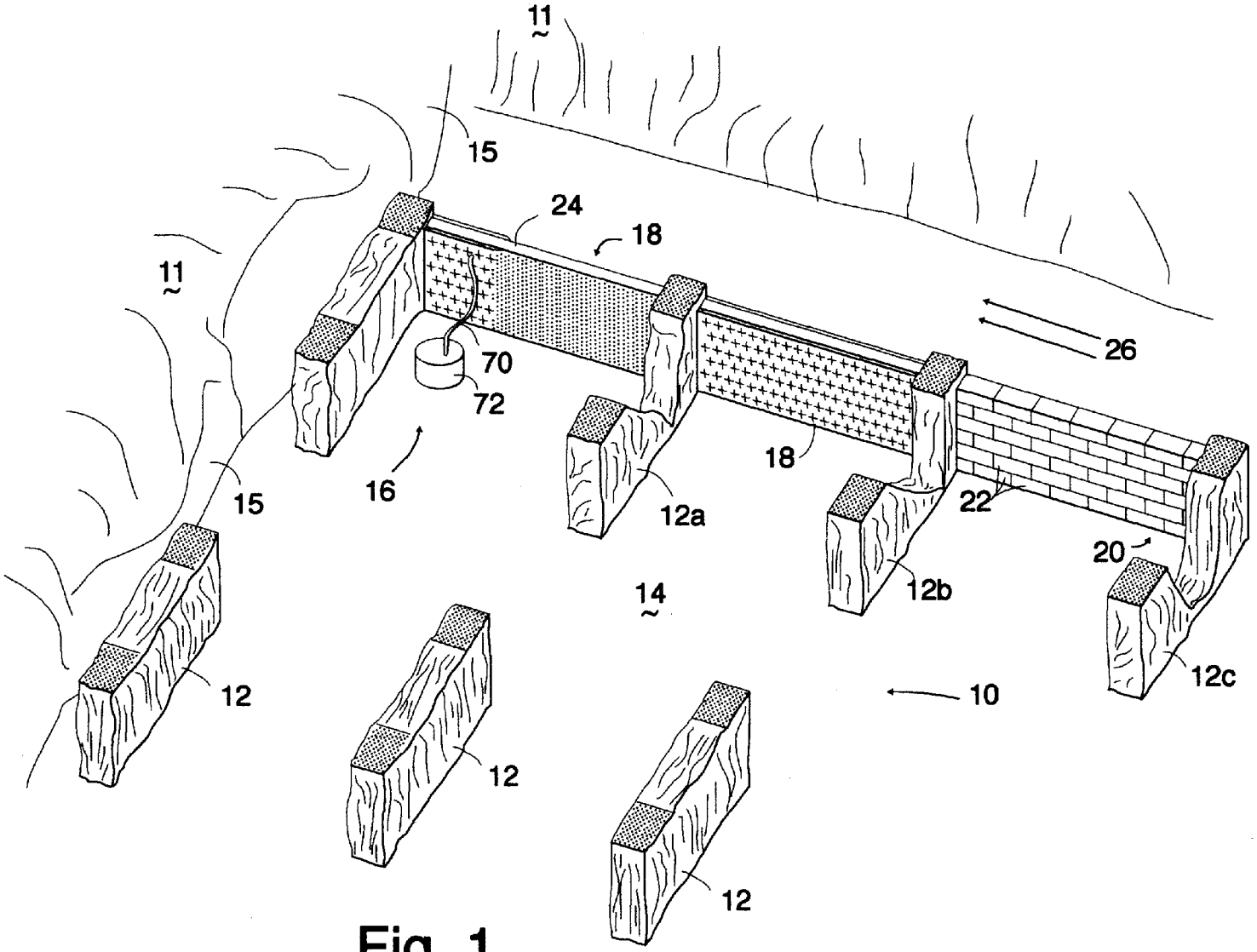
FIG. 1 is a perspective cut-away view of a mine gallery in which gallery walls according to the present invention are installed between pillars.

Referring now in more detail to the drawings, in which like numerals indicate like parts throughout the several views, FIG. 1 is a perspective cut-away view of a mine gallery generally 10 from which rock and mineral substances have been excavated from a strata generally 11 and leaving a plurality of spaced-apart pillars 12 for support between a ceiling of the gallery and a floor 14. For convenience of illustration, the pillars 12 are shown as narrow columns of strata. The pillars 12*a*, 12*b*, and 12*c* are partially broken away to provide a view of features of the gallery 10 and the present invention.

In order to communicate fresh air to a working face 15 of the mine, the "rooms" 16 defined by the pillars 12 are closed by walls or stoppings generally 18. FIG. 1 illustrates a prior art stopping 20 formed by assembling a plurality of conventional concrete blocks 22 in tiers between the floor 14 of the mine gallery 10 and the ceiling. A plurality of curtains 24 according to the present invention provide stoppings 18 between adjacent pillars 12 for defining light weight, easily constructed walls which define a passageway 26 between the gallery 10 and the strata 11. The passageway provides for communication of air from an intake, across the working face 15 of the excavation and out through a return, with the arrow illustrating the direction of air flow along the passageway 26. The passageway 26 also provides access to the working face 15 of the mine.

Figure 2:
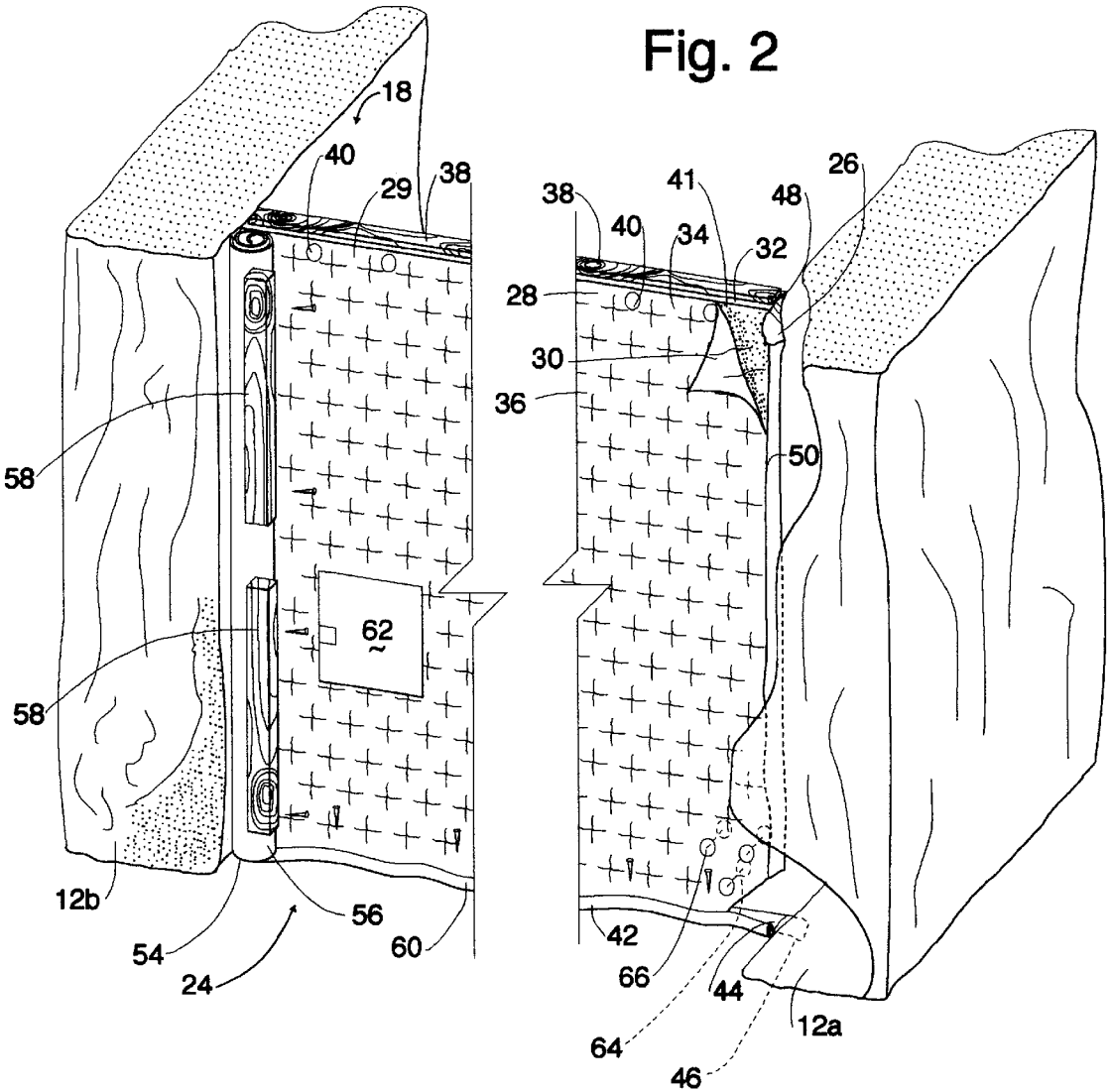
FIG. 2 is a detailed perspective cut-away view of a curtain according to the present invention for installation between adjacent pillars, as illustrated in FIG. 1.

FIG. 2 is a perspective cut-away view illustrating one stopping 18 secured between pillars 12*a* and 12*b*. The stopping 18 is formed with the curtain 24 which comprises two layers of sheet materials 26, 23. The layers 26, 28 are joined together with a plurality of spaced-apart short cords 30 which define connector strands extending between the sheet materials 26, 28. The cords 30 are connectors or fasteners placed at regular intervals and in sufficient number to provide the curtain 24 with a substantially rectangular vertical cross section. The sheet materials 26, 28 are preferably woven and joined together by the cords 30 simultaneously on a loom. A fire-resistant coating 29 is applied to the exterior surfaces of the sheets 26, 28 after installation of the curtain, as discussed below. In the illustrated embodiment, the spaced-apart pair of sheets 26, 28 define an opening 32 therebetween at an upper edge 34 of the curtain. The upper portion 36 of the curtain 24 attaches to a header board 38 which is secured with fasteners to the ceiling. The header board extends between the pillars 12*a* and 12*b*. A plurality of spaced-apart openings 40 are formed in the upper portion 36 of the curtain, for a purpose discussed below. An expandable foam 41 fills an interior cavity defined by the spaced-apart sheets 26, 28.

Figure 3:
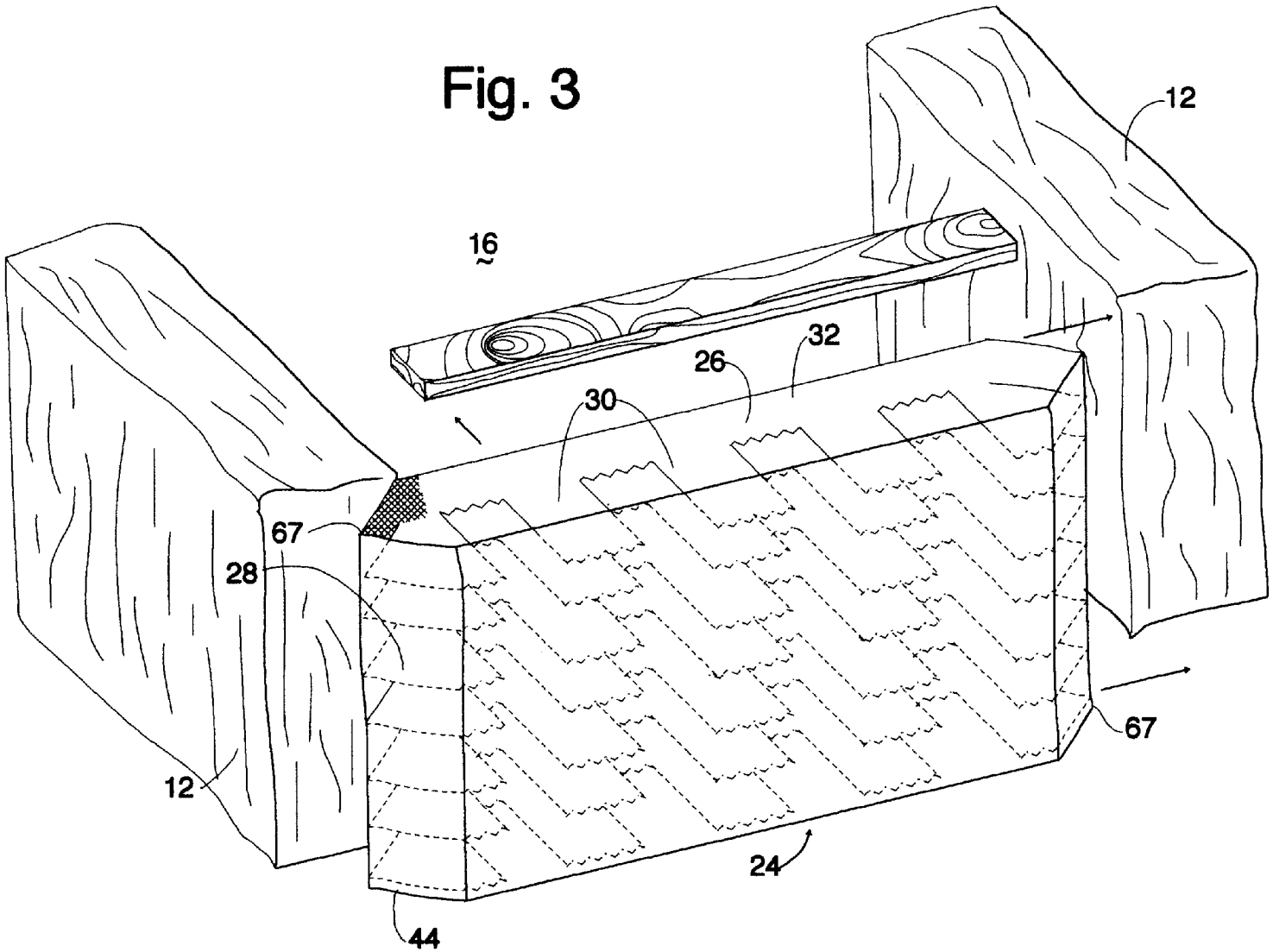
FIG. 3 is a perspective view of an alternate embodiment of the curtain according to the present invention.

The bottom 42 of the curtain 24 is defined by a baffle or web 44 of fabric material attached at a lower edge 46 of the curtain 24 during manufacture thereof. In the embodiment illustrated in FIG. 2, the side faces 48 of the curtain 24 are also closed by a web SC. The web 50 on one side abuts against a side face of once of the pillars 12. At a longitudinally distal end 54 of the curtain 24, the excess length of the material of the sheets 26, 28 are rolled to form a roll 56. Spads or fasteners are driven through the roll 56 and into the strata of the pillar 12. In an alternate embodiment (illustrated) a spad board 58 is positioned against the roll 56 and fasteners driven therethrough to secure the curtain 24 to the pillar 12. A bottom portion 60 of the curtain 24 is secured with fasteners to the floor 14 of the mine 10. A manhole door 62 is positioned in the stopping 18 illustrated in FIG. 2. FIG. 2 further illustrates an alternate embodiment of the cords 30, which comprise connector 64, such as nylon cords, which connect to disks 66 on the outside faces of the sheets 26, 28. FIG. 3 is an alternate embodiment of the curtain 24 in which the longitudinally distal ends 67 of the sheets 26, 28 are joined together by stitching or sewing. This embodiment is more easily manufactured than the one in which the baffles are installed at the distal ends of the sheets 26, 28. In this embodiment, the excess length of the curtain 24 is accommodated by rolling either or both distal ends, in order to install the curtain between pillars 12 as discussed below.

With reference to FIGS. 1 and 2, a plurality of the curtains 24 are used to define stoppings 18 between pillars 12 in the mine 10. The header board 18 is secured to the ceiling between the pillars 12*a* and 12*b*. The curtain 24 is brought to the gap between the pillars 12*a* and 12*b*, and the side 48 is aligned with the pillar 12*a*. The curtain 24 is raised by grasping the upper portion 36 of each sheet 26, 28 to move the upper edge 34 to the header boards 38. The curtain 24 is moved laterally to juxtapose the side 48 against the pillar 12*a*. Fasteners (not illustrated) are used to secure the upper portion 36 of each sheet 26, 28 to the header board 48 on both sides of the curtain 24. The fasteners are staples, nails, or similar securing devices. The curtain 24 is thereby suspended from the ceiling of the mine perpendicular to the floor 14 of the mine gallery 10.

In an alternate embodiment (not illustrated) vertical supports are used to temporarily wedge the curtain against the ceiling. Fasteners are then used to secure the bottom portion 42 to the floor 14 with the web 44 disposed against the floor. The distal ends 54 of the sheets 26, 28 are formed into rolls 56 on each side of the curtain 24. The spad boards 58 are placed over the rolls 56 and fasteners are driven through the spad boards and the rolls into the strata of the pillar 12*b*. The curtain 24 thus installed defines a bladder for receiving the hardenable foam material.

The openings 40 are then formed by cutting slits with a knife in the upper portion of the curtain 24. The openings 40 are preferably spaced-apart and define ports for connecting to a hose 70 (as illustrated in FIG. 1) which communicates an expandable hardenable material which forms a foam from a supply 72 into the cavity space between the sheets 26, 28 in the curtain 24. The material falls through the cavity to the bottom web 44. The material foams and thereafter expands and fills the cavity between the sheets 26, 28. The cords 30 allow the curtain 24 to expand to a predetermined width set by the length of the cords 30. When the curtain expands to the maximum allowable width, the curtain becomes relatively stiff. This forces the foam to move vertically and laterally as the foam expands. The width of the certain 24 is defined by the length of the cords 30, which can range from a few inches to many inches. Several widths were evaluated in a range from four to eighteen inches. The foam causes the web 38 to closely conform to the side face of the pillar 12*a*. The foam expands against the pillar 12*b*, the header board 38 on the ceiling, and the web 44 against the floor 14. This provides a substantially air tight seal between the curtain 24 and the surfaces of the mine gallery 10. The fasteners securing the bottom 42 of the curtain 24 prevent the curtain from moving laterally during insertion and expansion of the foam. After the foam hardens, the exterior surface of the sheets 26, 28 are coated with the fire-resistant coating 29. Such coating 29 may be eliminated when using a fire resistant foam.

The embodiment illustrated in FIG. 2 includes the manhole door 62. After the foam cures, a saw is used to cut an opening in the stopping 18 for the door 62. The manhole door 62 is positioned in the opening and secured thereto, for providing access between the rooms 16 separated by the stopping 18.

Accordingly, the present invention provides a curtain 24 which comprises a bladder defines by the spaced-apart sheets 26, 28 which receives the hardenable foam 41 and a fire resistant coating 29, for walling-off gaps between pillars 12 in mine galleries 10. The bladder provides a structural form for the foam. The cords 30, which fasten the two sheets 26, 28 together, allow the bladder to expand to the predetermined width. When the bladder expands to the maximum allowable width, the bladder becomes relatively rigid forcing the foam to move vertically and laterally as the foam expands.

The bladder is preferably constructed of flexible materials with sufficient impermeability to restrict significant movement of the foam through pores or seams of the sheets 26, 28. Some limited weeping is desirable as the foam enmeshes with the yarns of the fabric sheets 26, 28. It was also found that polymer films such as nylon and polypropylene may be used gainfully for forming the bladder. Fabrics, woven and non-woven, including nylon, polyethylene, nylon and polypropylene, and polyester may be used for the sheets 26, 28 in the curtain 24.

The foam 41 that fills the cavity of the bladder is preferably a flowable material which hardens. The hardenable material is preferably a low density foamable material in a range of about 0.5 to about 5.0 pounds of foamable material per cubic foot of foam in the cavity. The foam 41 is formed mechanically or by chemical reaction. The use of the hardenable material provides the structural strength of the invention, as well as insulation from communicating heat. The foam preferably is a polymeric MDI polyester/polyol combination (polyurethane or phenolic) which can produce low density foams. In addition, phenol-formaldehyde foams are also well known for their low density and fire resistance.

The components of the foam are pumped from a supply 72 into the bladder. Such foams commonly expand between about thirty and about one hundred times the original liquid volume. The foam expands the bladder to the maximum width and then moves vertically and laterally until the foam reaches the ceiling of the mine and the sides of the pillars to form an air-tight seal. The foam typically hardens within fifteen minutes.

A fire retardant coating is then applied to the exposed surfaces of the bladder. The fire retardant coating is preferably in compliance with federal requirements for fire protection in mires. In a preferred embodiment, the fire retardant coating includes sodium silicate as a binder and clay as a filler. An example of this technology is found in U.S. Pat. No. 5,043,019 Chervanak, et al.

In an embodiment, the bladder was constructed of a woven nylon fabric, with nylon cords woven into the bladder as to give it a maximum width of 4.5 to 6 inches. For seals where strength is important, the bladder may be wider. The hardenable material was then pumped into the bladder and allowed to harden. The hardenable materials in this example is a two-component polyurethane foam calibrated to 1.0 pounds per cubic foot. The wall 25 was then coated with a sodium silicate/clay based coating. The length of the cords 30 and the spacing of the cords can be varied to increase or decrease the thickness of the stopping wall.

In another embodiment, the bladder was constructed of a nylon film, three mils thick, with ct nylon connector 64 inserted through the bladder. The nylon connector engages the disk 66 on each distal end to provide a bearing surface outwardly of the film. The hardenable material was then pumped into the bladder and allowed to harden. The hardenable materials in this example was a two-component polyurethane foam calibrated to 0.75 to 2.5 pounds per cubic foot. The wall 18 was then coated with a sodium silicate/clay based coating. The length of the connector in the bladder can be varied to increase or decrease the thickness of the wall.

Compression Test Description

An 8 inch ×7 inch ×11 inch sample was placed in an hydraulic press. Orientation of the sample placed the 7 inch ×8 inch face exposed to the top of the press with an eleven inch height. One inch steel plates were placed upon the top and bottom of the sample. Gauge measurements were in tons. Total stroke of the ram is nine inches. Pressure was applied continuously. Gauge measurements never reached 2000 lbs. The cylinder maximized the stroke compressing the sample to 2.75 inches in height. Some minor bulging was observed (approximately 0.3 inches per side) in the polyurethane sample (experiment 1). When the ram was released the polyurethane sample relaxed and recovered to 7.25 inches. The polyurethane foam sample (Experiment 1) density was 1.25±0.25 pounds per cubic foot and the phenol foam sample (Experiment 2) density was 2.0 pounds per cubic foot.

TABLE 1

Compression Test Results

| | Maximum Compression | | Permanent Displacement | |
|---|---|---|---|---|
| Experiment | (Inches) | (%) | (Inches) | (%) |
| 1 | 2.75 | <24% | 3.75 | 35% |
| 2 | 2.75 | <24% | 8.25 | 75% |

Flexural Strength Test Description

This test was conducted in accordance with ASTM E72-80 Transverse Load Tests on Wall Panels. The walls were tested for flexural strength, ¼ point load on an 80 inch clear span, using a calibrated hydraulic jack assembly, with an effective area of 26.1 square feet.

The phenolic foam samples were phenol-formaldehyde resin containing MDI and cured using a sulfonic acid. These materials are available from American Foam Technologies. The polyurethane samples were prepared by mixing a polymeric MDI and a polyol available from Prime Resins, Inc. The mixture was poured into a bladder made of nylon. In samples in which the bag was stripped away, a nylon film bag was used. Samples in which the bladder was tested with the sample, a woven nylon bladder was used. Two polyurethane foam densities 1.25 (±0.25) pounds per cubic foot and 0.75 (±0.25) pounds per cubic foot were used to produce the samples for testing.

It was found that a woven bladder with fasteners produced a much high lateral strength than samples produced with bladders constructed of film and fasteners.

TABLE 2

Flexural Strength Test

| Experiment | Wall Size Description (' = feet; " = inches) | Load Pounds PSI | Flexural Strength |
|---|---|---|---|
| 3 | 4'1" × 8'4" × 12" 2.0 lb. Phenolic foam, no bladder | 700 | 26 |
| 4 | 4'2" × 8'2" × 11" 2.0 lb. Phenolic foam, no bladder | 1500 | 57 |
| 5 | 4'0" × 8'2" × 11.5" 2.0 lb. Phenolic foam, no bladder | 1900 | 75 |
| 6 | 4'2" × 8'1" × 12" 1.5 lb. Polyurethane foam, no bladder | 2600 | 103 |
| 7 | 4'3" × 8' × 13" 1.5 lb. Polyurethane foam, no bladder | 2900 | 115 |
| 8 | 4' × 8'3" × 14" 1.5 lb. Polyurethane foam, no bladder | 2400 | 96 |
| 9 | 4'2" × 8'1" × 5.5" 1.0 lb. Polyurethane foam, woven nylon bladder | | 47.9 |
| 10 | 4'3" × 8' × 5.5" 1.0 lb. Polyurethane foam, woven nylon bladder | | 44.9 |
| 11 | 4'3" × 8' × 5.5" 1.0 lb. Polyurethane foam, woven nylon bladder | | 51.7 |

Fire Endurance Test Description

This test was conducted in accordance with ASTM E-119 Fire Endurance Testing. Sample 12 was prepared by mixing MDI and a polyol that expanded to a foam density of 1.25±0.25 pounds per cubic foot. The foam was poured into a nylon bladder of a size 6 feet ×8 feet ×7 inches. The final product varied in thickness from ten to fourteen inches in thickness due to a "pillow" effect caused by the fasteners on the inside of the bladder. A sodium silicate-based fire retardant coating manufactured by Sandvik Rock Tools, Inc. was applied to a thickness of ¼ inch (±0.125 inch). The sample was coated on all six sides. The sample was allowed to cure for thirty two days before testing.

Sample 13 was prepared by mixing MDI and a polyol that expanded to a foam density of 0.75±0.25 pounds per cubit foot. The foam was poured into a nylon bladder of a size 6 feet ×8 feet ×8 inches. The final product varied in thickness from 5.5 to 8 inches in thickness due to the pillow effect caused by the fasteners on the inside of the bladder. A sodium silicate based fire retardant coating manufactured by Sandvik Rock Tools, Inc. was applied to a thickness of ¼ inches (±0.125 inches). The sample was coated on all six sides. The sample was allowed to cure for fifteen days before testing.

The furnace used in this test measures 3 feet ×3 feet ×3 feet. The outside construction is steel and the furnace is lined with a ceramic-refractory insulation. The furnace dimensions inside the insulation are nominally 27 inch ×27 inch ×27 inch. A single burner is centered vertically in the wall opposite the sample. This burner is rated for 1.5 million BTU per hour and is of the flat flame or non-impinging flame design. The furnace condition are monitored by three Inconel-sheathed chromel-alumel thermocouples positioned 6 inches from the face of the sample. The test was run following the ASTM E119 Time-Temperature Curve.

TABLE 3

Fire Endurance Test

| Experiment | Time (Minutes) | Observation |
|---|---|---|
| 12 | 20 | Some smoke/steam emitted from the top of the sample. |
| | 35 | Smoke/steam was emitted from the side of the sample |
| | 60 | Average sample temperature 79° F. Average furnace temperature 1729° F. Average ambient temperature 57° F. |
| | 62 | The furnace was turned off and the sample remained intact with no holes on the backside of the sample. |
| 13 | 15 | Some smoke/steam emitted from the top of the sample. |
| | 60 | Average sample temperature 215° F. Average furnace temperature 1682° F. Average ambient temperature 68° F. |
| | 66 | The furnace was turned off and the sample remained intact with no holes on the backside of the sample. |

In both tests the exposed surface of the wall intumescenced and formed a large 'blister'. The center of the 'blister' increased the thickness of the wall by four to six inches. In experiment 12, the foam was consumed during the test leaving a foam thickness of three to nine inches. In sample 13, most of the foam was completely consumed immediately behind the exposed surface. Adjacent areas were relatively unaffected. The unexposed wall began to "blister" to a thickness of four to six inches at the center.

Surface Flammability of Materials Test Description

This test was conducted in accordance with ASTM Designation E-162 "Standard Method of Test for Surface Flammability of Materials Using a Radiant Heat Energy Source." Four samples (18 inches ×6 inches ×6 inches) were prepared by mixing 100 milliliter of MDI and a polyol and spreading the mixture over the non-combustible substrate. The result was a ¼ inch tc ⅜ inch thickness of foam. While the foam was still wet a nylon fabric was placed over the whole surface and trimmed to fit the sample. The fabric was taken from a nylon bladder. After curing for one hour, the fire retardant coating made by Sandvik Rock Tools, Inc. was applied tc a thickness of ¼ inch. The samples were allowed to dry for two days at room temperature. Samples were conditioned to equilibrium at a controlled temperature of 73° F. for four days.

TABLE 4

Flame Spread Test

| Experiment | Flame Spread Factor | Heat of Evolution | Flame Spread Index |
|---|---|---|---|
| 14 | 1.0 | 2.83 | 2.83 |
| 15 | 1.39 | 2.45 | 3.41 |
| 16 | 1.72 | 1.89 | 3.25 |
| 17 | 1.93 | 2.83 | 5.46 |
| Average | 1.51 | 2.50 | 3.74 |

The present invention provides a light-weight, easily assembled stopping 18 having significantly reduced materials and labor requirements for installation. The low density foam is ductile and resists damage due to strata movement. Further, the foamed stoppings 18 provide substantially air tight seals when the curtains 24 are installed. The foam forces the baffles into the cracks and crevices of the peripheral surfaces of the mine gallery, such as pillars, ceilings, and floors, which seals the curtains and interlockings the curtain and the surrounding strata.

The principles, preferred embodiments, and modes of operation of the present invention have been described in the foregoing specification. The invention is not to be construed as limited to the particular forms disclosed because these are regarded as illustrative rather than restrictive. Moreover, variations and changes may be made by those skilled in the art without departure from the spirit of the invention as described by the following claims.

What is claimed is:

1. A curtain for defining a stopping in an underground passageway between a pair of spaced-apart pillars to block and direct air flow in underground passageways, comprising:

a bladder defined by two opposing flexible, woven substantially air permeable sheets joined together by a plurality of connectors interwoven therewith, which connectors each have a length to define a cavity between the sheets, said bladder being suspended from a ceiling of a passageway in a mine; and a foam disposed within the cavity and becoming rigid in situ and making the sheets substantially air impermeable, and being formed of a flowable hardenable material introduced into the cavity, the foam formed of a low density material in a range of between about 0.5 to about 5 pounds of the hardenable material per cubic foot of foam, whereby a light-weight stopping is defined in the passageway of the mine.

2. The curtain as recited in claim 1, wherein the longitudinal ends of the bladder define an opening which is exposed to a side face of a pillar in a mine, wherein a substantially air-tight seal is defined between the bladder and the pillar.

3. The curtain as recited in claim 1, wherein each one of a pair of opposing longitudinal ends of the bladder are closed by a respective baffle attached to and extending between the sheets.

4. The curtain as recited in claim 1, wherein the longitudinal ends of the bladder are closed by sewing the sheets together.

5. The curtain as recited in claim 1, wherein a bottom of the bladder is defined by a baffle extending between the sheets and attached to a lower edge thereof.

6. The curtain as recited in claim 1, further comprising a coating applied to an exterior surface of said bladder after the hardenable material has hardened.

7. The curtain as recited in claim 6, wherein said coating is fire resistant.

8. The curtain as recited in claim 7, wherein said fire resistant coating is comprised of a sodium silicate and a clay base.

9. The curtain as recited in claim 1, wherein said bladder is comprised of a material relatively impermeable to the hardenable material.

10. The curtain as recited in claim 1, wherein said hardenable material is a foamable plastic material.

11. The curtain as recited in claim 10, wherein said foamable plastic material is selected from the group comprising polyurethanes, phenolics, and polyesters.

12. A method of forming a barrier in an underground passageway between a pair of spaced-apart pillars to block and direct air flow in underground passageways, comprising the steps of:

(a) suspending a bladder defined by two opposing flexible, woven substantially air permeable sheets from a ceiling of an underground passageway;

(b) introducing into the bladder a low-density foam formed of a hardenable material in a range of about 0.5 to about 5.0 pounds of material per cubic foot of foam;

(c) enmeshing a portion of the foam with yarns of the woven sheets to secure the sheets to the foam;

(d) curing said low density foam to define a substantially rigid, air-impermeable wall in the underground passageway.

13. The method as recited in claim 12, further comprising the step of securing the bladder on its sides and bottom with fasteners to the sides and floor of the mine gallery prior to step (b).

14. The method as recited in claim 12, further comprising the step of (E) applying a coating to the exterior surfaces of said bladder after the hardenable material has hardened.

15. The method as recited in claim 14, further comprising the step of selecting said hardenable material from the group of foamable plastic materials including but limited to polyurethanes, phenolics, and polyesters.

* * * * *